US012312712B2

(12) United States Patent
Lindemann et al.

(10) Patent No.: US 12,312,712 B2
(45) Date of Patent: May 27, 2025

(54) AIR JET SPINNING MACHINE AND DRAFTING SYSTEM UNIT FOR A SPINNING UNIT OF AN AIR JET SPINNING MACHINE

(71) Applicant: Saurer Intelligent Technology AG, Arbon (CH)

(72) Inventors: Lars Lindemann, Meerbusch (DE); Eduard Prediger, Mönchengladbach (DE); Michael Reimann, Grevenbroich (DE); Philipp Schiffers, Erkelenz (DE)

(73) Assignee: Sauer Intelligent Technology AG, Arbon (CH)

( * ) Notice: Subject to any disclaimer, the term of this patent is extended or adjusted under 35 U.S.C. 154(b) by 0 days.

(21) Appl. No.: 18/452,781

(22) Filed: Aug. 21, 2023

(65) Prior Publication Data

US 2024/0068133 A1 Feb. 29, 2024

(30) Foreign Application Priority Data

Aug. 25, 2022 (LU) ..... 502705

(51) Int. Cl.
*D01H 5/56* (2006.01)
*D01H 5/74* (2006.01)

(52) U.S. Cl.
CPC ..... *D01H 5/56* (2013.01); *D01H 5/74* (2013.01)

(58) Field of Classification Search
CPC ..... D01H 5/56; D01H 5/70; D01H 5/74
USPC ..... 57/315
See application file for complete search history.

(56) References Cited

U.S. PATENT DOCUMENTS 1,395,284 A * 11/1921 Leonard ..... D01H 5/56 19/294
5,303,454 A * 4/1994 Stahlecker ..... D01H 5/56 19/294
2006/0272132 A1* 12/2006 Stahlecker ..... D01H 5/56 19/236

(Continued)

FOREIGN PATENT DOCUMENTS

EP 1431433 A1 6/2004
EP 2752513 A1 7/2017

(Continued)

OTHER PUBLICATIONS

Search Report for corresponding Luxembourg application No. 502705 dated Mar. 29, 2023.

*Primary Examiner* — Shaun R Hurley
(74) *Attorney, Agent, or Firm* — Leason Ellis LLP

(57) ABSTRACT

An air jet spinning machine and a drafting system unit for a spinning unit produce a thread or roving from a supplied fiber strip, with a front roller pair including a front top roller on a load carrier and a driven front bottom roller on a bottom roller carrier, and a bearing element arranged on the bottom roller carrier for movably bearing an air jet spinning nozzle. A reliable pivotable air jet spinning nozzle which can be released from the bottom roller carrier is implemented by the bottom roller carrier including a bearing element having a free end, for receiving the air jet spinning nozzle, wherein the bearing element forms a pivot axis for pivoting the air jet spinning nozzle between an operating position and a second position, wherein the bearing element is connected to a portion spaced apart from the free end on the bottom roller carrier.

8 Claims, 5 Drawing Sheets

(56) References Cited

U.S. PATENT DOCUMENTS

| | | | | |
|---|---|---|---|---|
| 2009/0052824 | A1* | 2/2009 | Schmitz | D01H 5/565 384/491 |
| 2012/0297748 | A1* | 11/2012 | Malina | D01H 5/82 57/315 |
| 2023/0016534 | A1* | 1/2023 | Dressen | D01H 1/115 |

FOREIGN PATENT DOCUMENTS

| | | | | |
|---|---|---|---|---|
| JP | 2009068126 | A | 4/2009 | |
| WO | WO-2021116083 | A1 * | 6/2021 | D01H 1/115 |

* cited by examiner

AIR JET SPINNING MACHINE AND DRAFTING SYSTEM UNIT FOR A SPINNING UNIT OF AN AIR JET SPINNING MACHINE

CROSS-REFERENCE TO RELATED PATENT APPLICATIONS

This application claims priority to Luxembourg Patent Application No. 502705 filed Aug. 25, 2022, which is incorporated by reference in its entirety.

The invention relates to a drafting system unit for a spinning unit of an air jet spinning machine for producing a thread or roving from a supplied fiber strip, with

- at least one front roller pair consisting of a front top roller on a load carrier and a driven front bottom roller on a bottom roller carrier and forming a clamping line, and
- a bearing element arranged on the bottom roller carrier for movably bearing an air jet spinning nozzle.

Drafting system units for textile machines are known in various embodiments from the prior art. They are used to draw or draft a fiber band, thereby causing a reduction in cross-section of the fiber. During the drafting process, the fibers must be displaced relative to one another as uniformly as possible in order to achieve a fiber band that is as uniform as possible.

In order to draw the fiber strip, the drafting system units generally have a plurality of roller pairs arranged one after the other, which are arranged adjacent to one another and clamp the fiber band extending between them. In this case, a pair of rollers usually consists of a driven bottom roller arranged on a bottom roller carrier and a bottom roller resting against the lower roller and arranged on a pivotable load carrier, which top roller is rotatably held by the load carrier. Drafting of the fiber strip is achieved in that, in the transport direction of the fiber strip through the drafting system unit defined by the direction of rotation of the roller pairs, the peripheral speed of roller pair to roll pair increases.

In the case of air jet spinning by means of a spinning machine for spinning a thread, the fiber strip is typically drawn in accordance with the thread fineness to be achieved by means of the drafting system unit and then fed to an air jet spinning nozzle of an air jet spinning device. Within the air jet spinning device, the outer fibers of the fiber strip are wound around the inner core fibers of the fiber strip by means of a vortex air flow generated by the air jet spinning nozzle and thereby form the wrapping fibers which are crucial for the desired thread strength of the thread. The thread thus formed is finally drawn off via a draw-off channel of the air jet spinning device and is wound onto a tube, for example.

In the case of known drafting system units, the air jet spinning nozzle is arranged on the bottom roller carrier of the drafting system unit downstream of the front roller pair of the drafting system unit in the transport direction of the fiber strip. In order to arrange the air jet spinning nozzle on the bottom roller carrier, it is known to use holders to be connected to the bottom roller carrier and adapted thereto, to which holders the air jet spinning nozzle is pivotably arranged so that it can be adjusted between an operating position in which the fiber strip emerging from the front roller pair is conveyed into the air jet spinning nozzle, and a maintenance position. In the maintenance position, for example, there is the possibility for easy cleaning of the region between the spinning nozzle and the front roller pair. In order to remove the spinning nozzle completely from the bottom roller carrier, for example for carrying out maintenance work, it is necessary in the holders known from the prior art to remove said holders with the spinning nozzles arranged thereon from the bottom roller carrier, for example by releasing corresponding screw connections which fix the holder to the bottom roller carrier. In this case, the air jet spinning nozzle is generally arranged pivotably on the holder via two opposite bearing points, which also have a high positional tolerance.

In the case of air jet spinning by means of a roving machine for spinning a roving, the fiber strip produced, for example, by a draw frame, the so-called draw frame sliver, is fed to the roving machine. The roving machine comprises an air jet spinning device, such as described above, for example, wherein the dimensioning and the flow conditions of the air jet spinning device for producing the roving are suitably adapted to an air jet spinning device for producing a thread. The mode of operation of such an air jet spinning device of the roving machine for producing a roving is similar to that of the air jet spinning devices of air jet spinning machines for producing a thread.

Proceeding from this, the invention is based on the object of providing a drafting system unit for a spinning unit of an air jet spinning machine and an air jet spinning machine which has a reliable pivotable air jet spinning nozzle which, if necessary, can be released from the bottom roller carrier in a simple manner, in particular without tools.

The invention solves the object by a drafting system unit having the features of at least one front roller pair consisting of a front top roller on a load carrier and a driven front bottom roller on a bottom roller carrier and forming a clamping line, and a bearing element arranged on the bottom roller carrier for movably bearing an air jet spinning nozzle, with the bottom roller carrier comprising a bearing element having at least one free end, via which the air jet spinning nozzle can be received, wherein the bearing element forms a pivot axis for pivoting the air jet spinning nozzle between an operating position and at least one second position spaced apart therefrom, wherein the bearing element is connected to a portion spaced apart from the free end on the bottom roller carrier, and by an air jet spinning machine having the features of a guide element arranged on the bottom roller carrier having a guide surface extending parallel beyond the free end and at a distance from the bearing element. Advantageous further developments of the drafting system unit include the second position being a maintenance position or a position different therefrom, the bearing element having a stop element in a portion opposite the free end, the bearing element being designed in the region of the free end for receiving a position securing element, the bearing element being arranged on a pivot axis carrier of the bottom roller carrier, the bearing element being formed by a bearing pin held stationary by the pivot axis carrier, in particular a bearing pin pressed or screwed into the pivot axis carrier, and the bearing element being arranged in such a manner that the air jet spinning nozzle can be pivoted along a direction of movement extending transversely to the axis of rotation of the front roller, in particular extending orthogonally, between the operating position and at least the second position.

According to a preferred embodiment, the air jet spinning machine may be such a spinning machine which is designed for producing a thread which can be wound onto a take-up spool tube for forming a take-up spool, in particular a so-called cross-wound spool.

According to a further preferred embodiment, the air jet spinning machine can be a roving machine for producing a roving, as described for example at the outset. In such a roving machine, the air jet spinning device is designed such that the roving produced has a reversible protective twist. A reversible protective twist of this kind is known to be characterized in that the roving remains capable of being drawn for a further processing process, such as, for example, on the ring spinning machine, wherein the introduced imparted twist can be dissolved again if necessary. The reversible protective twist is usually achieved in such a way that the fiber strip fed to the air jet spinning device is at least partially granted a true twist by the air jet spinning device. This is to be understood as meaning that at least some of the fibers of the supplied fiber strip are given a true twist in the course of the air jet spinning process, that is to say a rotation which is achieved by means of the air flow generated in the air jet spinning device.

Characteristic for the drafting system unit according to the invention is that the bottom roller carrier comprises a bearing element having a free end, via which the air jet spinning nozzle can be received and which forms a pivot axis for pivoting the air jet spinning nozzle between an operating position and at least one second position spaced apart therefrom, wherein the bearing element is connected to the bottom roller carrier by a portion spaced from the free end. The second position, with respect to the operating position defining the first position, is a position more distant from the front roller than the operating position. For example, the second position can define a maintenance position in which maintenance activities, as described by way of example, can be carried out. Alternatively, the second position can be a position different from the maintenance position. In particular, the second position can be between the operating position and the maintenance position or a position further away from the front roller with respect to the maintenance position. In the latter preferred case, the second position is provided downstream of both the operating position and the maintenance position in a direction extending from the front roller. The second position can further preferably define an end position for the pivotable air jet spinning nozzle, in which the air jet spinning nozzle may have a largest possible distance to the front roller.

The portion for connection to the bottom roller carrier can preferably be an end of the bearing element opposite the free end. As a result, the bearing element can be formed in a defined and cost-effective manner. Alternatively, the portion can be a portion located between the free end and a further, in particular free, end of the bearing element located opposite thereto. If necessary, this favors further arrangement possibilities of further components on the bearing element. The connection of the bearing element to the bottom roller carrier via the portion is basically freely selectable. According to a preferred embodiment, the bottom roller carrier has a fastening receptacle which is designed to receive the portion of the bearing element. Further preferably, at least the fastening receptacle or the portion of the bearing element is designed to enable a stationary fixing of the bearing element on the bottom roller carrier. This can take place, for example, by means of a screw fastening or clamping fixing, which is further preferably spring-loaded.

The embodiment of the drafting system unit according to the invention allows the air jet spinning nozzle to be arranged in an easy manner on the bottom roller carrier or to remove it therefrom. In order to arrange the air jet spinning nozzle on the bottom roller carrier, it only has to be pushed onto the bearing element via the free end with an opening adapted to the free end of the bearing element. A removal of the air jet spinning nozzle from the bottom roller carrier can in turn be carried out by simply sliding the air jet spinning nozzle down from the bearing element via the free end. The bearing element, which is free at one end, thus allows simple assembly and disassembly of the air jet spinning nozzle on the bottom roller carrier and also offers the possibility of pivoting the air jet spinning nozzle about the pivot axis formed by the bearing element between the operating position and the second position spaced apart therefrom. Furthermore, a one-sided bearing of the bearing element on the bottom roller carrier allows a particularly precise and backlash-free alignment of the pivot axis with respect to the bottom roller carrier.

In order to fix the position of the air jet spinning nozzle in the pushing-on direction of the air jet spinning nozzle onto the bearing element, in particular along the pivot axis, it is provided according to a preferred embodiment of the invention that the bearing element has a stop element in a portion opposite the free end. The use of a stop element, for example in the form of a shoulder or flange encircling the pivot axis or the bearing element, preferably at least partially or further preferably completely, allows an exact positioning of the air jet spinning nozzle in the pushing-on direction onto the bearing element, so that the air jet spinning nozzle can be arranged in the operating position in an optimal manner relative to the front roller pair. A separate alignment is therefore not required.

According to a further preferred embodiment of the invention, the air jet spinning nozzle is fixed in a positionally secure manner on the bearing element. Here, the position securing of the air jet spinning nozzle may be basically freely selectable. In particular, for securing the position of the air jet spinning nozzle on the bearing element, it is provided that the bearing element is designed to receive a position securing element in the region of its free end. The use of a position securing element, for example by means of a screw fastening or a clamping fixing, which further preferably can be formed in a spring-loaded manner, ensures in a reliable manner that the air jet spinning nozzle does not slide off the bearing element in an undesired manner. For example, the position securing element can be a screw that can be screwed onto the free end of the bearing element, a snap ring that can be arranged on the free end of the bearing element, or an, in particular spring-loaded, pressure piece. Spring-loaded pressure pieces are generally known and offer the advantage over a conventional clamping screw that the tip of the pressure piece is designed to be movable in a spring-loaded manner. As soon as a spring force acting on the tip of the pressure piece, which acts as a clamping force, is overcome, the tip shifts in the direction of the pressure piece or into the pressure piece, whereby the component or the air jet spinning nozzle held by the spring-loaded pressure piece can be displaced on the bearing element. Alternatively or additionally, the bearing element and a carrier carrying the air jet spinning nozzle, which can be pushed onto the bearing element, may in a preferred manner have a tongue-and-groove-catch mechanism, similar in effect to the preferred embodiment with the spring-loaded pressure piece, which are then engaged or disengaged along the pushing-on direction of the air jet spinning nozzle when a defined force along the pushing-on direction is overcome. In contrast to the spring-loaded pressure piece, no spring-loaded pressure element such as the tip of the spring-loaded pressure piece is provided. Further alternatively or additionally, a locking lever can be provided, which is arranged so as to be rotatable transversely to the pushing-on direction on the bottom roller carrier in order to secure the air jet spinning nozzle after positioning on the bearing element to prevent movement counter to the pushing-on direction. The preferred use of a snap ring as a position securing element is characterized in that, on the one hand, it ensures a reliable securing of the position of the air jet spinning nozzle on the bearing element and, on the other hand, allows a simple and rapid removal, if necessary, so that the air jet spinning nozzle can then be removed from the bearing element in an easy manner.

The embodiment of the bearing element forming the pivot axis for the air jet spinning nozzle is basically freely selectable. This can also be designed in one piece with the bottom roller carrier. According to a preferred embodiment of the invention, it is provided that the bearing element is arranged on a pivot axis carrier of the bottom roller carrier. This preferred embodiment of the invention offers the possibility of removing the bearing element from the bottom roller carrier, if necessary, and replacing it with a new bearing element, for example in order to enable the use of alternative air jet spinning nozzles on the drafting system unit. According to a particularly preferred embodiment of the invention, it is provided that the bearing element is formed by a bearing pin which is held in a stationary manner by the pivot axis carrier and is further preferably pressed or screwed into the pivot axis carrier. The use of a bearing pin which is in particular pressed in or screwed in ensures a high degree of positional security with a very low bearing tolerance, so that optimal positioning of the air jet spinning nozzle relative to the fiber strip emerging from the front roller pair can be ensured in a particularly reliable manner. Alternatively, the bearing pin can also be fastened to the bottom roller carrier or the pivot axis carrier via other fastening types, such as, for example, via a clamping or latching device, a bayonet catch or the like. For the type of fastening, it is fundamental to select the one that allows a stationary mounting of the bearing pin on the bottom roller carrier or the pivot axis carrier.

The arrangement of the bearing element relative to the front roller pair is also basically freely selectable. According to a preferred embodiment of the invention, it is provided that the bearing element is arranged in such a manner that the air jet spinning nozzle can be pivoted along a direction of movement extending transversely to the axis of rotation of the front roller, further preferably extending orthogonally, between the operating position and at least the second position. Further preferably, the bearing element is arranged in such a manner that the air jet spinning nozzle can be pivoted tangentially to the front bottom roller between the operating position and the second position. According to this further preferred embodiment of the invention, the pivot axis runs parallel to the clamping line of the front roller pair and the pivot axis, the axis of rotation of the front bottom roller and the axis of rotation of the front top roller lie in a common plane, i.e., span a common plane. As a result of the preferred or further preferred embodiment of the invention, the spinning nozzle can be displaced from the operating position at least into the second position, which can constitute the maintenance position and/or an end position for the pivotable air jet spinning nozzle that is different from the operating position, in a direction of movement, which facilitates the dissolution of thickenings in the yarn. In particular, the further preferred embodiment of the tangential pivoting of the air jet spinning nozzle to the front roller contributes to the further improved dissolution of thickenings in the yarn.

In order to facilitate the assembly of the air jet spinning nozzle on the bearing element, according to a further preferred embodiment of the invention, a guide element arranged on the bottom roller carrier having a guide surface extending parallel beyond the free end and extending at a distance from the bearing element is provided. The guide element serves as a stop element when mounting the air jet spinning nozzle on the bottom roller carrier, making it easier for the machine operator to arrange the air jet spinning nozzle on the bearing element. The air jet spinning nozzle is applied to the guide surface adjacent to the free end of the bearing element by the machine operator. When in contact with the guide surface, the air jet spinning nozzle can then be displaced in the direction towards the end of the bearing element opposite the free end of the bearing element by a movement oriented parallel to the guide surface. The spinning nozzle can thus be pushed onto the bearing element in a simple manner. The guide surface serves as an assembly aid which enables a particularly simple and rapid assembly of the air jet spinning nozzle on the bottom roller carrier.

The invention also achieves the object by means of an air jet spinning machine for producing a thread or roving from a supplied fiber strip, which has at least one drafting system unit described according to the invention or preferably further developed.

The air jet spinning machine according to the invention has the advantage that, if necessary, the air jet spinning nozzle can be removed from the spinning unit in a particularly simple and convenient manner. Maintenance and cleaning work can thus be conveniently carried out in a short time, resulting in only minimal downtime in the event of maintenance work.

Exemplary embodiments of the invention are explained below with reference to the drawings, wherein identical reference signs are used for identical functional elements. In the drawings.

Figure 1:
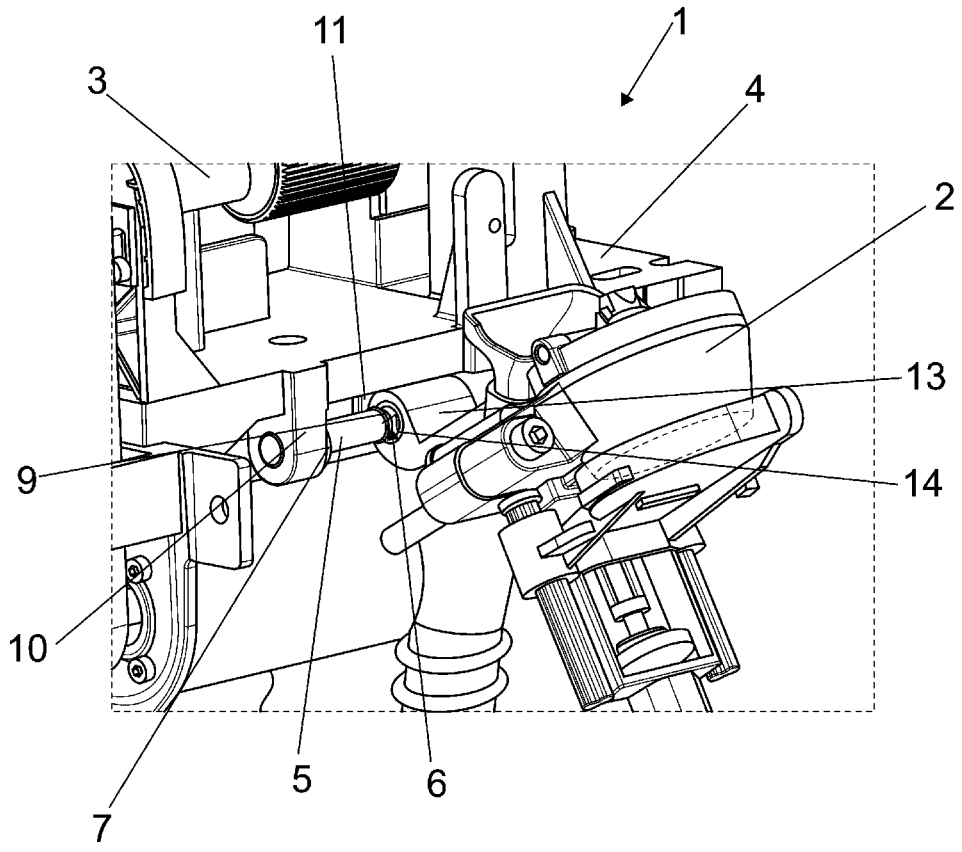
FIG. 1 is a schematic representation of a perspective view of a partial region of a drafting system unit with an air jet spinning nozzle being separated from a bearing element.
Figure 3:
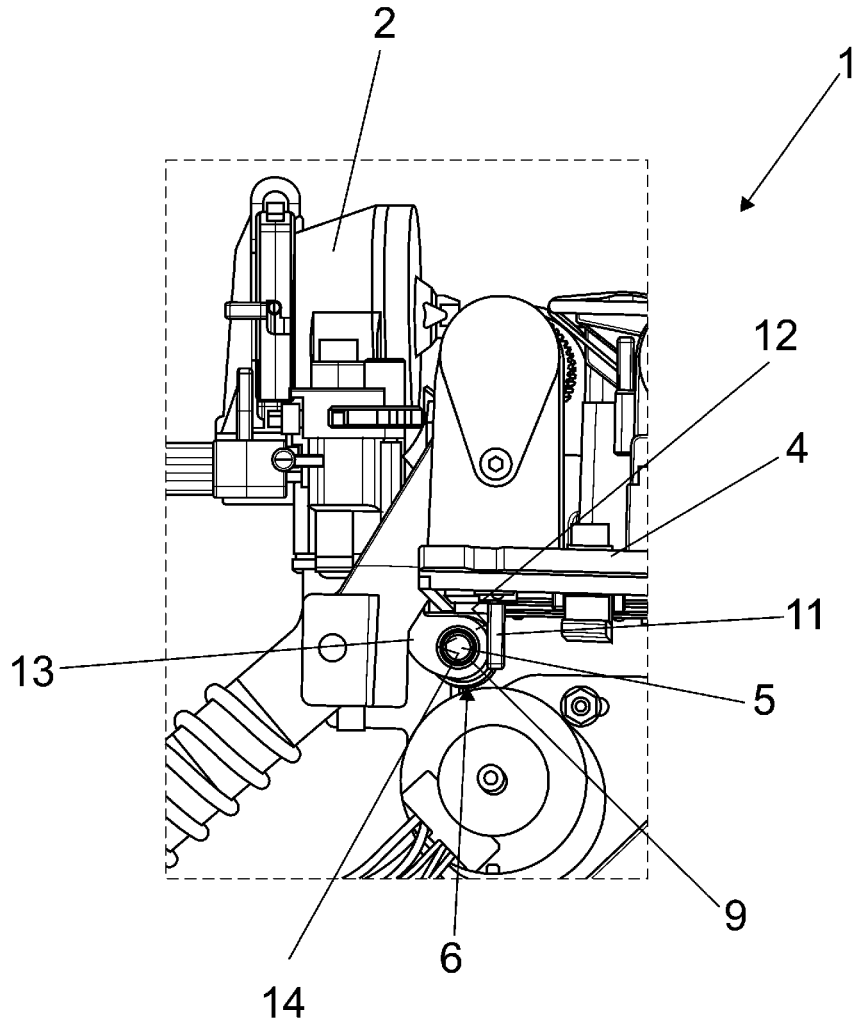
Figure 4:
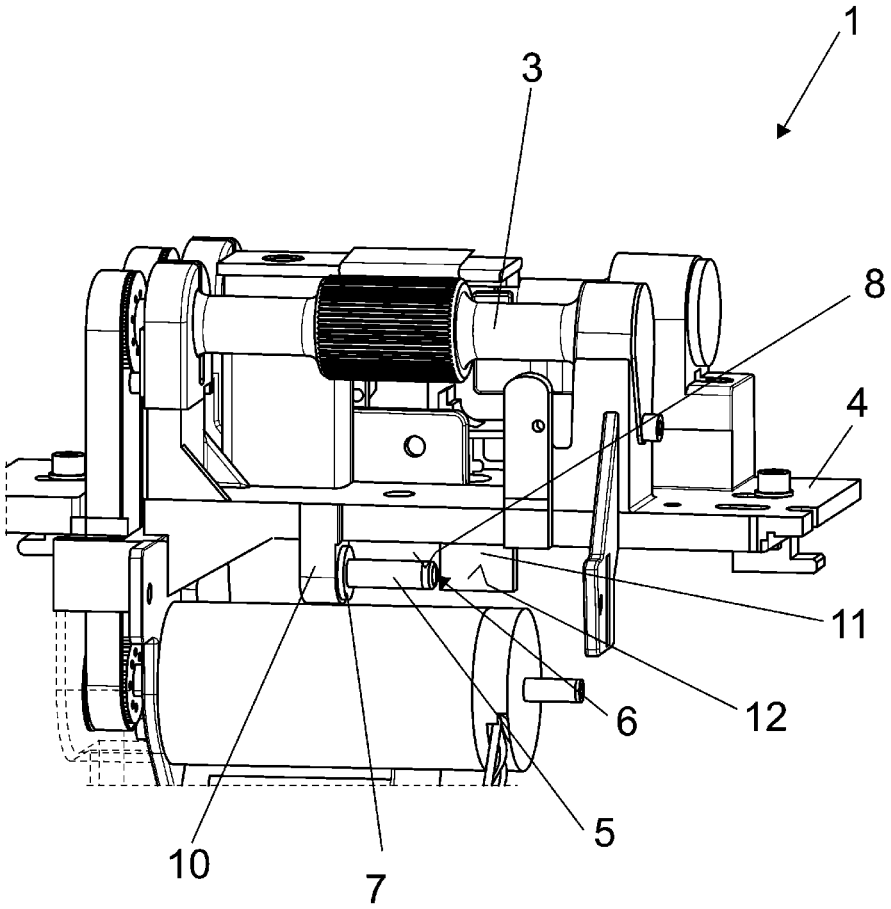
Figure 5:
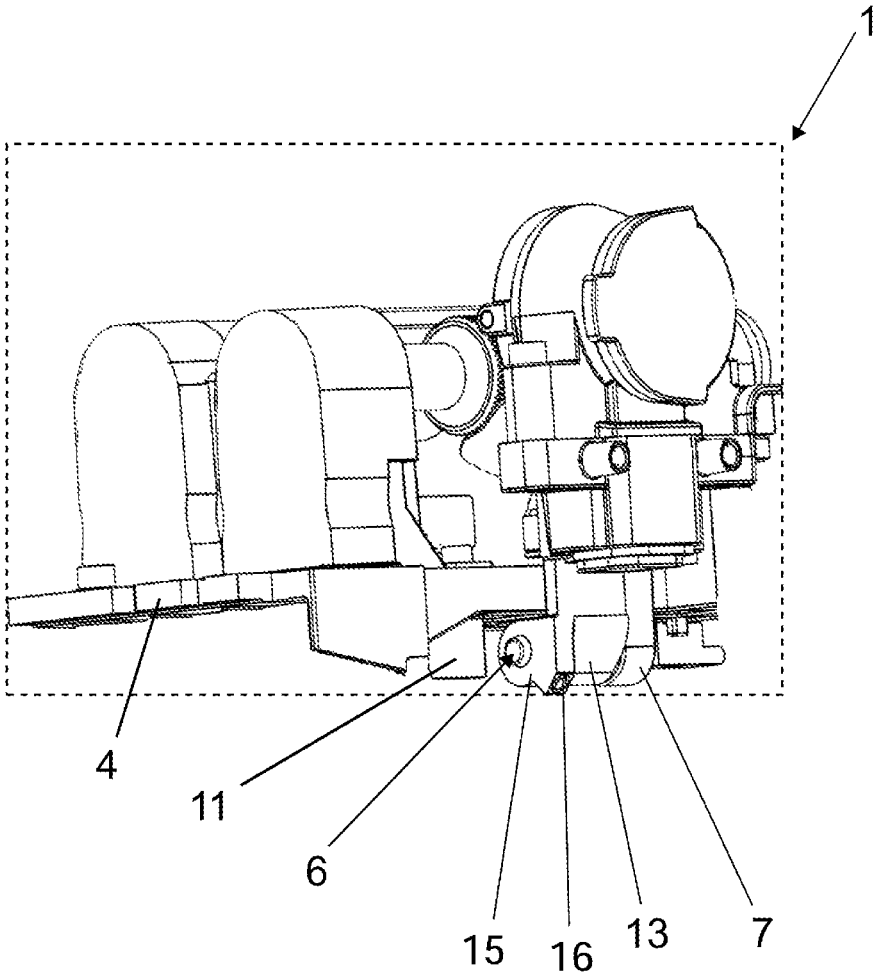

FIG. 3 is a schematic representation of a perspective view of a partial region of the drafting system unit of FIG. 1 with the air jet spinning nozzle being arranged in an operating position, FIG. 4 is a schematic representation of a perspective view of a partial region of the drafting system unit of FIG. 1, and FIG. 5 is a schematic representation of a perspective view of a partial region of a drafting system unit with the air jet spinning nozzle being arranged in an operating position according to a further embodiment.

A perspective section of a drafting system unit 1 shown in a schematic representation in FIG. 1 shows the connection region of an air jet spinning nozzle 2 in the region of a front bottom roller 3 on a bottom roller carrier 4 according to one embodiment. In FIG. 1, the air jet spinning nozzle is separated from the bottom roller carrier 4.

For arrangement on the bottom roller carrier 4, the air jet spinning nozzle 2 has a carrier 13 with a bearing element receptacle 14 extending through the carrier 13. For the arrangement of the air jet spinning nozzle 2 on the bottom roller carrier 4, the bearing element receptacle 14 is pushed onto a bearing element 5 designed as a bearing pin in the direction of a bearing element carrier 10 carrying the bearing pin until it reaches the pushed-on position on the bearing pin 5 shown in FIG. 2.

Figure 2:
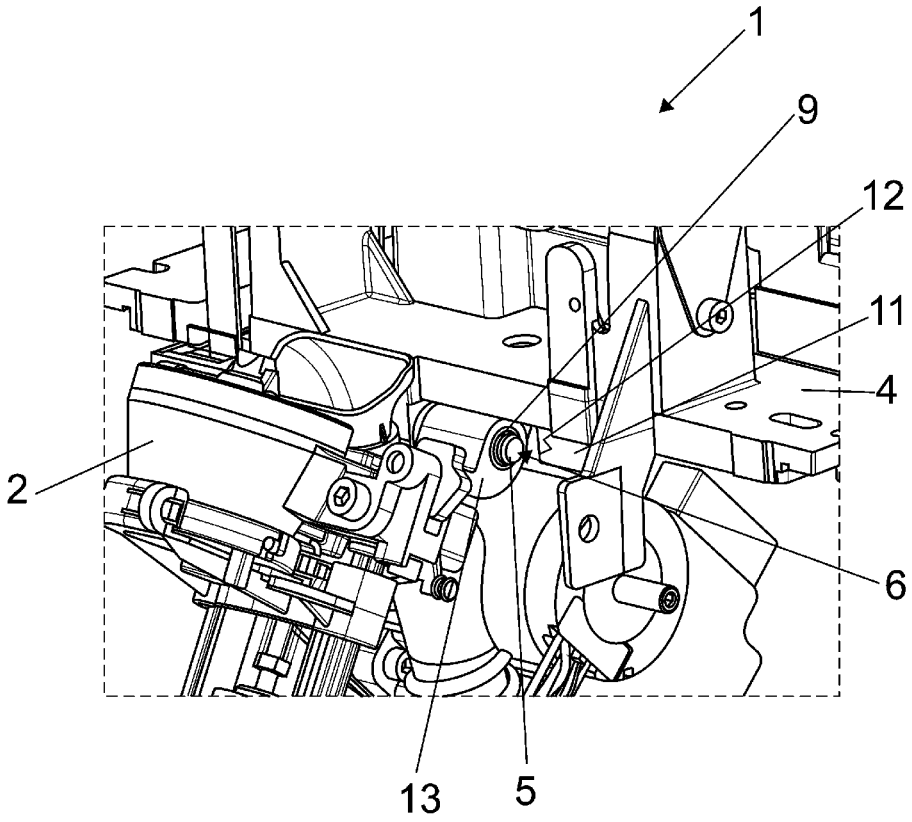
FIG. 2 is a schematic representation of a perspective view of a partial region of the drafting system unit of FIG. 1 with the air jet spinning nozzle pushed onto the bearing element in a maintenance position.

In the maintenance position of the air jet spinning nozzle 2 shown in FIG. 2, which according to an exemplary embodiment constitutes a second position, the latter is pushed completely onto the bearing pin via a free end 6 of the bearing pin, wherein an end face of the carrier 13 facing the bearing element carrier 10 rests against a circumferential stop element 7 of the bearing pin. To secure the pushed-on position of the air jet spinning nozzle 2 on the bearing pin, a snap ring 9 is used, which is inserted in the region of the free end 6 of the bearing pin into a groove 8 extending around the bearing pin.

To simplify the arrangement of the air jet spinning nozzle 2 on the bottom roller carrier 4, a guide element 11 is arranged on the bottom roller carrier 4, the guide surface 12 of which extends parallel to the bearing pin beyond its free end 6. In order to assemble the air jet spinning nozzle 2, in the position shown in FIG. 1, it is brought into contact with the guide surface 12 by the carrier 13 and, resting against the guide surface, is pushed via the free end 6 of the bearing pin onto the latter, until the carrier 13 rests with its end face facing the bearing element carrier 10 against the stop element 7 of the bearing pin (cf. FIG. 4).

From the maintenance position shown in FIG. 2, the air jet spinning nozzle 2 can be pivoted about the bearing pin or about the pivot axis formed by the bearing pin up to the operating position shown in FIG. 3 and back again, wherein the air jet spinning nozzle 2 in the operating position in the fiber strip transport direction is arranged downstream of the clamping line formed by the front bottom roller 3 and the front top roller, here not shown, for receiving the supplied fiber strip.

FIG. 5 shows a further exemplary embodiment, wherein, in contrast to the previous exemplary embodiment, the pushing-on direction of the air jet spinning nozzle 2 is reversed. The stop element 7 of the bearing pin is arranged along the pushing-on direction at the right end of the bearing pin, whereby the air jet spinning nozzle 2 can be pushed on from the left via the on the left arranged free end 6 of the bearing pin. The guide element 11 is arranged at a corresponding position on the bottom roller carrier 4. In the pushed-on state of the air jet spinning nozzle 2, the carrier 13 of the air jet spinning nozzle 2 has an end portion 15 pushed onto the bearing pin on the side facing the free end 6 of the bearing pin, said end portion having a bore for receiving a pressure piece 16, in particular a spring-loaded pressure piece. According to this exemplary embodiment, the pressure piece 16 is screwed into the bore 15 and engages with its tip in a recess formed on the bearing pin congruently to the tip of the pressure piece 16 and not shown, wherein the recess according to an exemplary embodiment is formed as a circumferential groove 8 on the bearing pin. As a result, the air jet pinning nozzle 2 can be fixed in a positionally secure manner on the bearing pin. To disassemble the air jet spinning nozzle 2, the pressure piece 16 is to be released in a defined manner in the unscrewing direction, as a result of which the air jet spinning nozzle 2 becomes freely movable along the pushing-on direction. The use of such a pressure piece 16, in particular a spring-loaded pressure piece, simplifies the assembly and disassembly of the air jet spinning nozzle 2 on or from the bearing pin.

LIST OF REFERENCE SIGNS

1 drafting system unit
2 air jet spinning nozzle
3 front bottom roller
4 bottom roller carrier
5 bearing element
6 free end
7 stop element
8 groove
9 snap ring
10 bearing element carrier
11 guide element
12 guide surface
13 carrier
14 bearing element receptacle
15 end portion of the carrier
16 pressure piece

The invention claimed is:

1. A drafting system unit for a spinning unit of an air jet spinning machine for producing a thread or roving from a supplied fiber strip, with at least one front roller pair consisting of a front top roller on a load carrier and a driven front bottom roller on a bottom roller carrier and forming a clamping line, and a bearing element arranged on the bottom roller carrier for movably bearing an air jet spinning nozzle having a nozzle carrier, characterized in that the bottom roller carrier comprises a guide element and the bearing element, wherein the guide element has a guide surface, wherein the bearing element has at least one free end, via which the air jet spinning nozzle can be received, wherein the bearing element forms a pivot axis for pivoting the air jet spinning nozzle between an operating position and at least one second position spaced apart therefrom, wherein the bearing element is connected to a portion spaced apart from the at least one free end on the bottom roller carrier, wherein the guide element is arranged on the bottom roller carrier and having the guide surface extending parallel beyond the at least one free end and at a distance from the bearing element, and wherein the air jet spinning nozzle is brought into contact with the guide surface by the nozzle carrier and, as the nozzle carrier is disposed against the guide surface, the air jet spinning nozzle is pushed via the at least one free end of the bearing element until the nozzle carrier rests against a portion of the bearing element.

2. The drafting system unit according to claim 1, characterized in that the at least one second position is a maintenance position or a position different therefrom.

3. The drafting system unit according to claim 1, characterized in that the bearing element has a stop element in a portion opposite the at least one free end.

4. The drafting system unit according to claim 1, characterized in that the bearing element is designed in the region of the at least one free end for receiving a position securing element.

5. The drafting system unit according to claim 1, characterized in that the bearing element is arranged on a pivot axis carrier of the bottom roller carrier.

6. The drafting system unit according to claim 5, characterized in that the bearing element is formed by a bearing pin held stationary by the pivot axis carrier, wherein the bearing pin is pressed or screwed into the pivot axis carrier.

7. The drafting system unit according to claim 1, characterized in that the bearing element is arranged in such a manner that the air jet spinning nozzle can be pivoted along a direction of movement extending transversely to the axis of rotation of the front roller, to extend orthogonally between the operating position and the at least one second position.

8. An air jet spinning machine for producing the thread or roving from the supplied fiber strip, characterized by the spinning unit having the drafting system unit according to claim 1.

* * * * *